US009976361B2

(12) United States Patent
Richards et al.

(10) Patent No.: US 9,976,361 B2
(45) Date of Patent: May 22, 2018

(54) METHOD AND SYSTEM FOR DIRECTING CONTROL LINES ALONG A TRAVEL JOINT

(71) Applicant: Halliburton Energy Services, Inc., Houston, TX (US)

(72) Inventors: William M. Richards, Flower Mound, TX (US); Phillip T. Thomas, The Colony, TX (US); Tyson Eiman, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 165 days.

(21) Appl. No.: 14/355,113

(22) PCT Filed: Feb. 21, 2013

(86) PCT No.: PCT/US2013/027074
§ 371 (c)(1),
(2) Date: Apr. 29, 2014

(87) PCT Pub. No.: WO2014/130032
PCT Pub. Date: Aug. 28, 2014

(65) Prior Publication Data

US 2015/0204145 A1 Jul. 23, 2015

(51) Int. Cl.
*E21B 17/07* (2006.01)
*E21B 17/02* (2006.01)
*E21B 19/00* (2006.01)

(52) U.S. Cl.
CPC ..... *E21B 17/07* (2013.01); *E21B 17/026* (2013.01); *E21B 17/028* (2013.01); *E21B 19/00* (2013.01)

(58) Field of Classification Search
CPC ..... E21B 17/07; E21B 19/00; E21B 17/028; E21B 17/026
See application file for complete search history.

(56) References Cited

U.S. PATENT DOCUMENTS 5,335,723 A 8/1994 Mouton
5,804,713 A 9/1998 Kluth
(Continued)

OTHER PUBLICATIONS

International Preliminary Report on Patentability issued in related PCT Application No. PCT/US2013/027074, dated Sep. 3, 2015 (9 pages).

(Continued)

*Primary Examiner* — D. Andrews
*Assistant Examiner* — Manuel C Portocarrero
(74) *Attorney, Agent, or Firm* — Scott Richardson; Baker Botts L.L.P.

(57) ABSTRACT

A method and system for installing one or more control lines on a travel joint is disclosed. A control line coil is arranged along a travel joint. An inner mandrel is coupled to an upper bushing and a lower bushing. The control line coil is wrapped along the outer surface of the inner mandrel. The control line coil comprises a first portion located proximate the upper bushing, a second portion located proximate to the lower bushing and a straight length control line extending between the first portion and the second portion. The first distal end of the straight length control line is coupled to the upper bushing and the second distal end of the straight length control line is coupled to the lower bushing.

20 Claims, 6 Drawing Sheets

(56) References Cited

U.S. PATENT DOCUMENTS

| | | | | |
|---|---|---|---|---|
| 6,196,325 | B1 | 3/2001 | Connell et al. | |
| 6,367,552 | B1 | 4/2002 | Scott et al. | |
| 6,367,565 | B1 | 4/2002 | Hall | |
| 6,540,025 | B2 | 4/2003 | Scott et al. | |
| 7,730,957 | B2 | 6/2010 | Blanton et al. | |
| 2002/0007948 | A1* | 1/2002 | Bayne | E21B 17/003 166/278 |
| 2004/0168794 | A1* | 9/2004 | Vold | E21B 17/025 166/65.1 |
| 2005/0045339 | A1 | 3/2005 | Hall et al. | |
| 2005/0072564 | A1 | 4/2005 | Grigsby et al. | |
| 2006/0000618 | A1 | 1/2006 | Cho et al. | |
| 2009/0032268 | A1 | 2/2009 | Blanton et al. | |
| 2009/0078430 | A1 | 3/2009 | Du | |
| 2010/0101778 | A1 | 4/2010 | Lembcke | |

OTHER PUBLICATIONS

International Search Report and Written Opinion issued in related International Application No. PCT/US2013/027074, dated Nov. 6, 2013, 12 pages.

Search Report issued in related European Application No. 13875843.8, dated Jan. 11, 2017 (8 pages).

* cited by examiner

METHOD AND SYSTEM FOR DIRECTING CONTROL LINES ALONG A TRAVEL JOINT

CROSS-REFERENCE TO RELATED APPLICATION

This application is a U.S. National Stage Application of International Application No. PCT/US2013/027074 filed Feb. 21, 2013, and which is hereby incorporated by reference in its entirety.

BACKGROUND

A Travel joint may be used in a production tubing string for installing a tubing hanger inside a wellhead after installing the production tubing string inside the completion equipment. The travel joint allows the production tubing string to shorten by axially telescoping the assembly. A Travel joint may be deployed from the surface in an extended position. The travel joint may then be released for telescoping or longitudinally collapsing by any suitable means. For instance, mechanical devices such as shear pins, J-Slots, metered hydraulic time releases, etc., may be used to manipulate the travel joint.

When performing subterranean operations, control lines may be coupled to the outside of the production tubing string to provide a path for power and/or data communication to various flow control devices and/or gauges attached to the production tubing string or the completion equipment downhole. In certain implementations, the control lines may be securely clamped to the outside of the production tubing string. The control lines may include electric cables, hydraulic cables, fiber optic cables, or a combination thereof. For instance, electric and/or hydraulic cables may provide power to various flow control devices downhole to control the rate of production flow into the production tubing string. Similarly, electric and/or fiber optic cables may transmit data from one or more sensors downhole relating to reservoir and fluid properties such as, for example, pressure, temperature, density, flow rate, fluid composition, and/or water content.

It is often desirable for one or more control lines to pass along a travel joint. However, the axial movements of the travel joint may prove problematic when directing control lines along the travel joint. Specifically, unlike the travel joint, the control lines are typically not extendable/retractable. This problem may be magnified in instances when multiple control lines need to traverse a travel joint. It may be particularly difficult for multiple control lines to traverse a travel joint due, in part, to the differences in the properties of electric, hydraulic, and fiber optic control lines such as differences in stiffness. It is therefore desirable to develop methods and systems to facilitate installation of one or more control lines that effectively traverse a travel joint.

BRIEF DESCRIPTION OF THE DRAWINGS

Some specific example embodiments of the disclosure may be understood by referring, in part, to the following description and the accompanying drawings.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

To facilitate a better understanding of the present invention, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may be implemented with tools that, for example, may be conveyed through a flow passage in tubular string or coiled tubing, downhole robot or the like.

For the purposes of this disclosure, the terms "couple" or "couples," as used herein are intended to mean either an indirect or a direct connection. Thus, if a first device couples to a second device, that connection may be through a direct connection, or through an indirect electrical connection via other devices and connections. The term "uphole" as used herein means along the drillstring or the hole from the distal end towards the surface, and "downhole" as used herein means along the drillstring or the hole from the surface towards the distal end.

The methods and systems disclosed herein may be used in conjunction with production, monitoring, or injection in relation to the recovery of hydrocarbons or other materials from the subsurface.

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

The present invention relates generally to spacing out operations and, more particularly, to method and system for installing one or more control lines on a travel joint.

Figure 1:
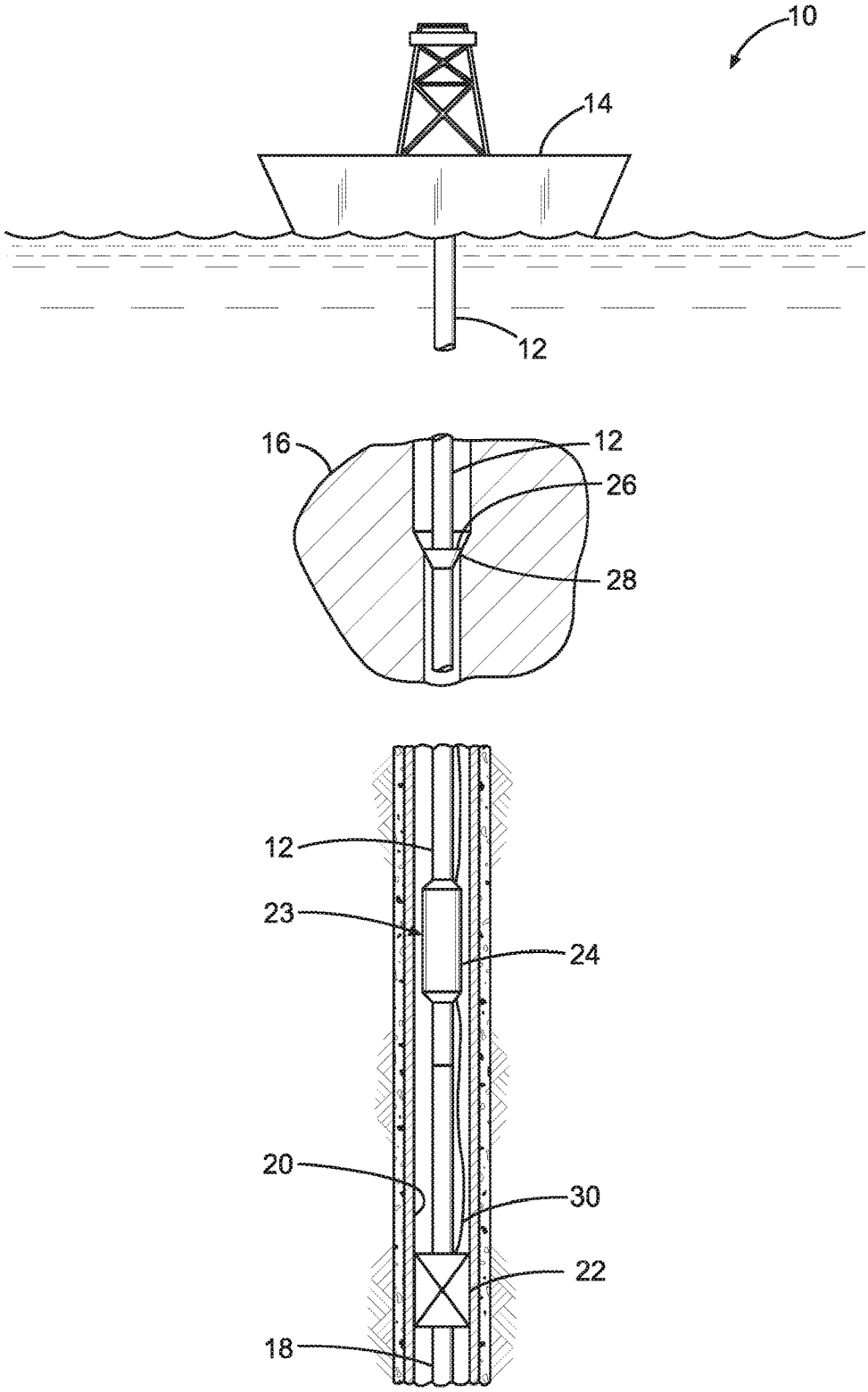
FIG. 1 depicts a system for performing subterranean operations in accordance with an illustrative embodiment of the present disclosure.

Turning now to FIG. 1, a system for performing subterranean operations in accordance with an illustrative embodiment of the present disclosure is denoted generally with reference numeral 10. In the system 10, a tubular string 12 extends downwardly from a drilling rig 14. The drilling rig 14 may be a floating platform, drill ship, or jack up rig. In certain illustrative embodiments, the tubular string 12 may be in a riser (not shown) between the drilling rig 14 and a wellhead 16. In other embodiments, a riser may not be used.

The tubular string 12 may be stabbed into a completion assembly 18 previously installed in a wellbore 20. In the illustrative embodiment of FIG. 1, the tubular string 12 is sealingly received in a packer 22 at an upper end of the completion assembly 18. In certain embodiments, the tubular string 12 may have a seal stack (not shown) thereon which seals within a sealed bore receptacle (e.g., above a liner hanger, etc.). The tubular string 12 may be connected with the completion assembly 18 using any suitable means known to those of ordinary skill in the art, having the benefit of the present disclosure, without departing from the scope of the present disclosure.

The completion assembly 18 may be used to "complete" a portion of the wellbore 20. Completing a wellbore, as used herein, refers to operations performed to prepare the wellbore for production or injection operations. The completion assembly 18 may include one or more elements which facilitate such production or injection operations. For instance, the completion assembly 18 may comprise elements including, but not limited to, packers, well screens, perforated liner or casing, production or injection valves, flow control devices, and/or chokes.

A travel joint system 23 may be used to axially shorten the tubular string 12 between the completion assembly 18 and the wellhead 16. After the tubular string 12 has been connected to the completion assembly 18, a travel joint 24 in the tubular string 12 may be released to allow the tubular string 12 to be landed in the wellhead 16. In the example of FIG. 1, a hanger 26 is landed on a wear bushing 28, but other manners of securing a tubular string in a wellhead which are known to those of ordinary skill in the art having the benefit of the present disclosure may be used without departing from the scope of the present disclosure.

The travel joint 24 permits some variation in the length of the tubular string 12 between the hanger 26 and the completion assembly 18. For instance, the travel joint 24 may allow the length of the tubular string 12 to shorten after the completion assembly 18 has been sealingly engaged, so that the hanger 26 can be appropriately landed in the wellhead 16.

The travel joint 24 may be any suitable travel joint. For instance, in certain implementations, the travel joint 24 may be the travel joint disclosed in U.S. Pat. No. 6,540,025, assigned to Halliburton Energy Services, Inc., which is incorporated by reference herein in its entirety. The illustrative travel joint disclosed in U.S. Pat. No. 6,540,025 includes a hydraulic release device which releases the travel joint in response to a predetermined compressive force being applied to the travel joint for a predetermined amount of time. The described travel joint also includes a resetting feature which permits the travel joint to be locked back in its extended configuration after having been compressed.

In certain implementations, the travel joint 24 of the system 10 may be comprised of other types of release mechanisms. For instance, in certain embodiments, the travel joint 24 may be one which is released in response to shearing one or more shear pins/screws with axial tension or compression. Alternatively, the travel joint 24 may be configured to be released by means of a j-slot or ratchet. Operation of such travel joints is well known to those of ordinary skill in the art, having the benefit of the present disclosure, and will therefore not be discussed in detail herein. As discussed in more detail below, the travel joint 24 is configured to facilitate passage of one or more control lines 30 therethrough while preserving operational integrity.

Figure 2A:
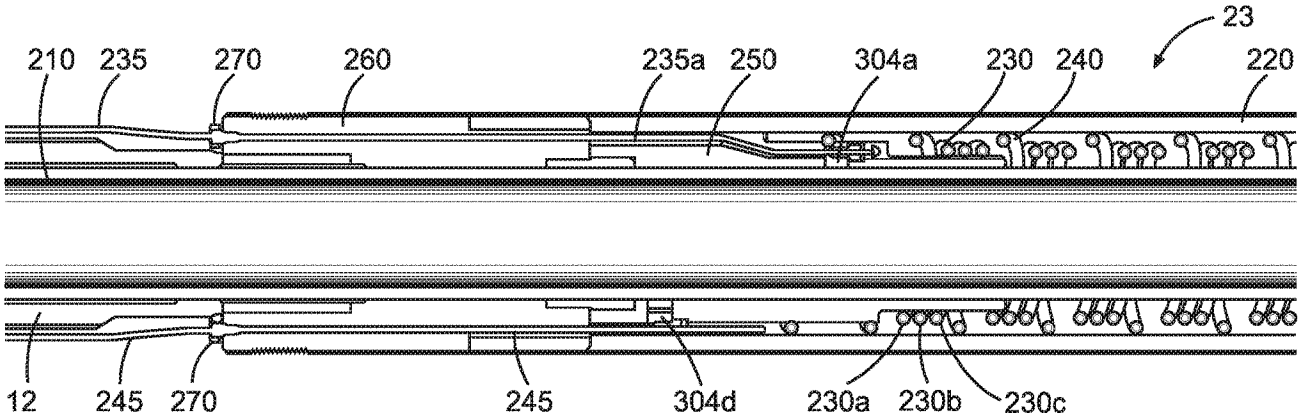
FIGS. 2A and 2B depict a cross-sectional view of layout of a travel joint assembly in accordance with an illustrative embodiment of the present disclosure.
Figure 2B:
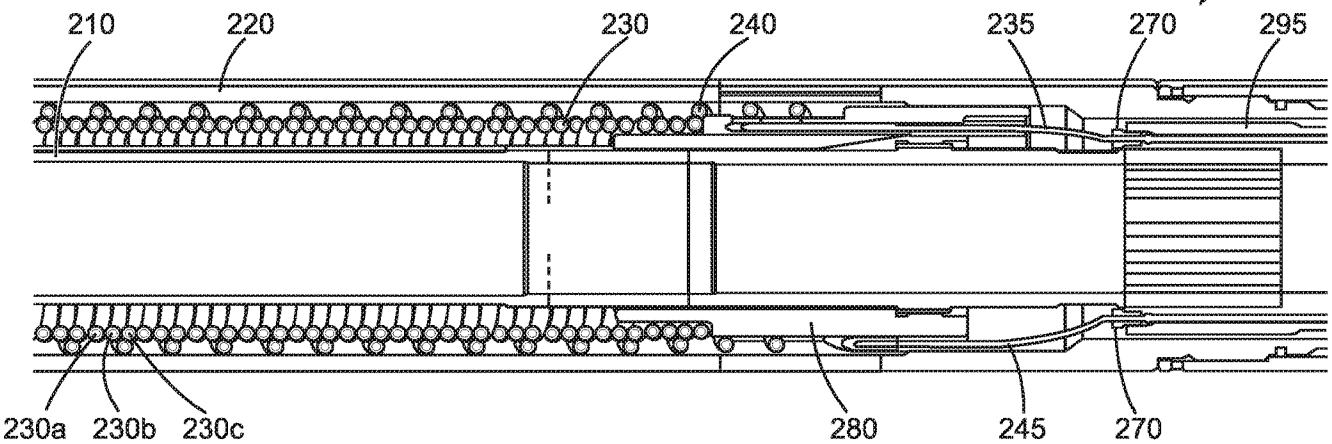

FIGS. 2A and 2B depict a cross-sectional view of layout of a travel joint assembly 23 in accordance with an illustrative embodiment of the present disclosure. The portion of the travel joint assembly 23 shown in FIG. 2A is located uphole relative to the portion of the travel joint assembly 23 shown in FIG. 2B and is referred to herein as an upper portion of the travel joint assembly 23. The term "upper portion" as used herein refers to the distal end of the travel joint assembly 23 that is located uphole relative to the opposing distal end. Accordingly, the terminology is equally applicable to deviated or horizontal wellbores and the present disclosure is not limited to vertical wellbores. As shown in FIG. 2A, the travel joint assembly 23 may comprise an inner mandrel 210. At its upper portion, the travel joint assembly 23 may include an outer housing 220 extending outside the inner mandrel 210. An inner control line coil 230 and an outer control line coil 240 may run along the outer surface of the inner mandrel 210 between the inner mandrel 210 and the outer housing 220. As shown in FIG. 2A, in certain implementations, the inner control line coil 230 and an outer control line coil 240 may be wrapped around the outer surface of the inner mandrel 210. The inner mandrel 210 may be positioned inside the inner control line coil 230 and the outer control line coil 240 may be installed over the inner control line coil 230.

In the illustrative implementation of FIGS. 2A and 2B, the inner control line coil 230 includes three distinct control lines denoted as 230*a*, 230*b*, 230*c*. In contrast, in the illustrative embodiments of FIGS. 2A and 2B, the outer control line coil 240 includes a single control line. However, the present disclosure is not limited to any specific number of control lines in each of the inner control line coil 230 and the outer control line coil 240 and more or fewer control lines may be utilized in each coil without departing from the scope of the present disclosure.

A straight length of control line 235*a*, 235*b*, 235*c* (shown in FIG. 3B) corresponding to each of the control lines 230*a*, 230*b*, 230*c* of the inner control line coil 230 may extend along the outside of the inner mandrel 210. The straight length of control lines 235*a*, 235*b*, 235*c* are collectively referred to as the inner straight length of control line 235. The straight length of control line 235*a* is shown in FIG. 2A for illustrative purposes while the straight length of control line 235*b* and 235*c* are depicted in FIG. 3B. Each of the straight length of control lines 235*a*, 235*b*, 235*c* may be coupled to an upper bushing 250. The upper bushing 250 (shown in FIG. 3B) extends along an outer surface of the inner mandrel. In certain embodiments, each of the straight length of control lines 235*a*, 235*b*, 235*c* may be coupled to the upper bushing 250 using corresponding anchor blocks 304*a*, 304*b*, 304*c* before it bends and becomes one of the control lines 230*a*, 230*b*, 230*c* of the inner control line coil 230.

Additionally, as shown in FIG. 2A, an outer straight length of control line 245 corresponding to outer control line coil 240 may extend along the outside of the inner mandrel 210. The outer straight length of control line 245 may be coupled to the upper bushing 250 using any suitable means, such as an anchor block 304*d*, in the same manner discussed above with respect to the straight length of control line 235*a*. Specifically, the outer straight length of control line 245 may be coupled to the upper bushing 250 with an anchor block 304*d* (shown in FIG. 3A) before bending to become a part of the outer control line coil 240. The configuration of the upper bushing 250 and the anchor blocks 304*a-d* is discussed in more detail below.

The inner straight length of control line 235 and the outer straight length of control line 245 may be directed downhole through an upper sub 260 and may each be sealingly fixed to the upper sub 260 by a corresponding control line fitting 270 as shown in FIG. 2A. In certain embodiments, the control line fitting 270 may be a swedge-lok type fitting, high integrity flange (HIF) fitting, or similar fitting that swedges on a ferrel fitting to anchor and seal the inner straight length of control line 235 and the outer straight length of control line 245 to the upper sub 260. The upper sub 260 may be threadingly coupled to the outer housing 220 and tubing string 12. The inner straight length of control line 235 and the outer straight length of control line 245 may continue to extend along the tubing string 12 and may be secured thereto with any suitable means including, but not limited to, cable clamps (not shown).

FIG. 2B depicts a cross sectional view of a lower end of the travel joint assembly 23 in accordance with an illustrative embodiment of the present disclosure. The inner straight length of control line 235 and the outer straight length of control line 245 extend into control lines 230*a*, 230*b*, 230*c* of the inner control line coil 230 and the outer control line coil 240 at the lower end of the travel joint assembly 23. The outer housing 220 and the inner mandrel 210 are continuous from FIG. 2A. The actual length of these components may depend on the amount of expansion or contraction needed for the travel joint assembly 23. As can be seen in FIG. 2B, the outer control line coil 240 may be coiled around the inner mandrel 210 on top of the inner control line coil 230 in the same manner discussed above in conjunction with FIG. 2A.

Similar to the configuration of the upper portion of the travel joint assembly 23, in the lower portion, the straight length of control lines 235*a*, 235*b*, 235*c* may extend from the inner control line coil 230 and pass through a lower bushing 280 and a lower sub 295 (as shown in FIG. 2B). Like the upper bushing 250, the lower bushing 280 extends along an outer surface of the inner mandrel 210. The straight length of control lines 235*a*, 235*b*, 235*c* may be fixed and sealingly engaged to the lower sub 295 by corresponding control line fittings 270. Similarly, the outer straight length of control line 245 may extend from the outer control line coil 240 and may be fixed to the lower sub 295 by a control line fitting 270.

As shown in FIGS. 2A and 2B, the outer control line coil 240 may be wound on top of the inner control line coil 230 on the inner mandrel 210. In certain embodiments, the inner control line coil 230 and the outer control line coil 240 may be wound clockwise or counter-clockwise and one or both of the coils may be encapsulated. In certain embodiments, the inner control line coil 230 and the outer control line coil 240 may be wound in opposite directions around the inner mandrel 210 in order to minimize interference or nesting during expansion and contraction. For instance, the inner control line coil 230 may be wound clockwise around the inner mandrel 210 and the outer control line coil 240 may be wound counter-clockwise around both the inner mandrel 210 and the inner control line coil 230. In other embodiments, inner control line coil 230 may be wound counter-clockwise around the inner mandrel 210 and the outer control line coil 240 may be wound clockwise around both the inner mandrel 210 and the inner control line coil 230. Additionally, in certain embodiments, the inner control line coil 230 and the outer control line coil 240 may be arranged so as to permit a telescoping movement of the inner mandrel 210 and the outer housing 220.

Figure 3A:
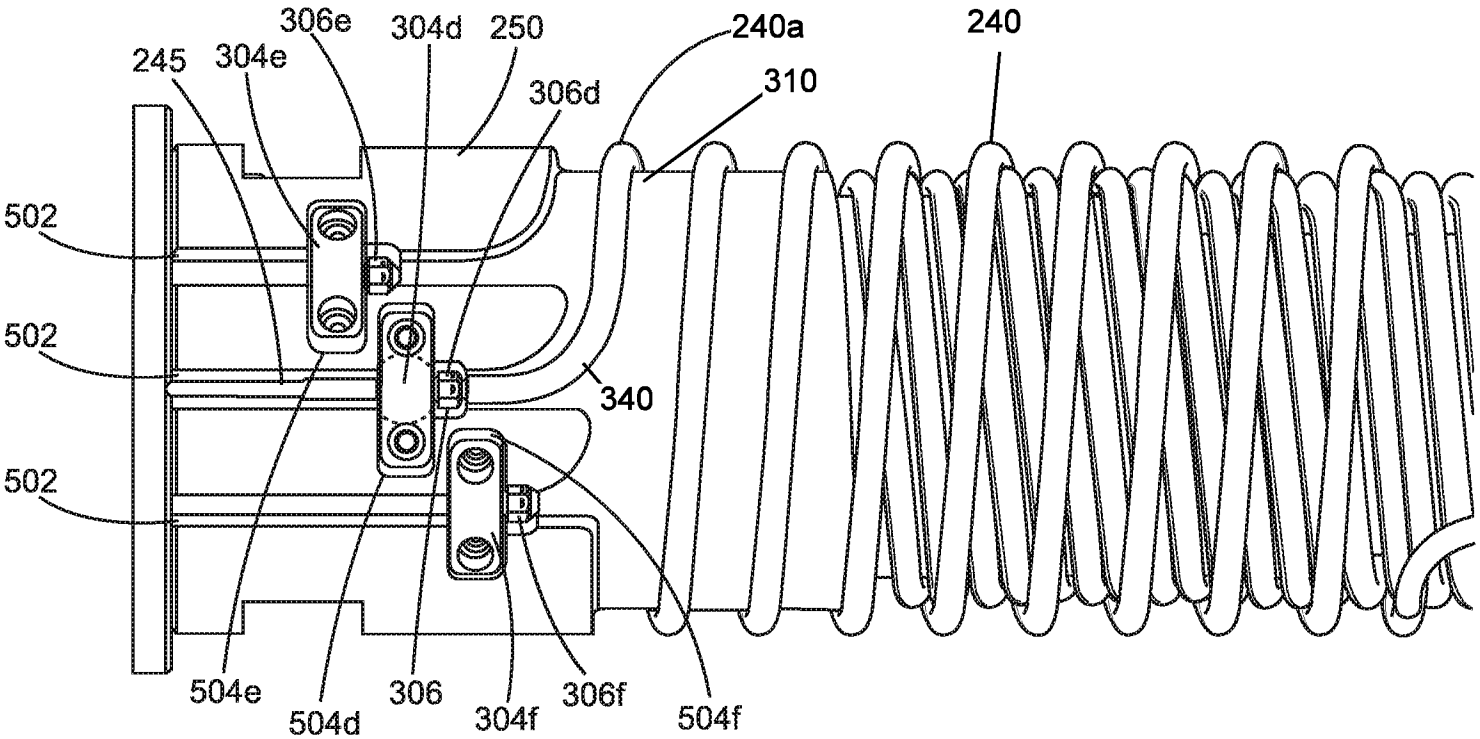
FIG. 3A depicts a perspective view of an upper portion (also referred to as the "top sub") of the travel joint assembly of FIG. 2A in accordance with an illustrative embodiment of the present disclosure.
Figure 3B:
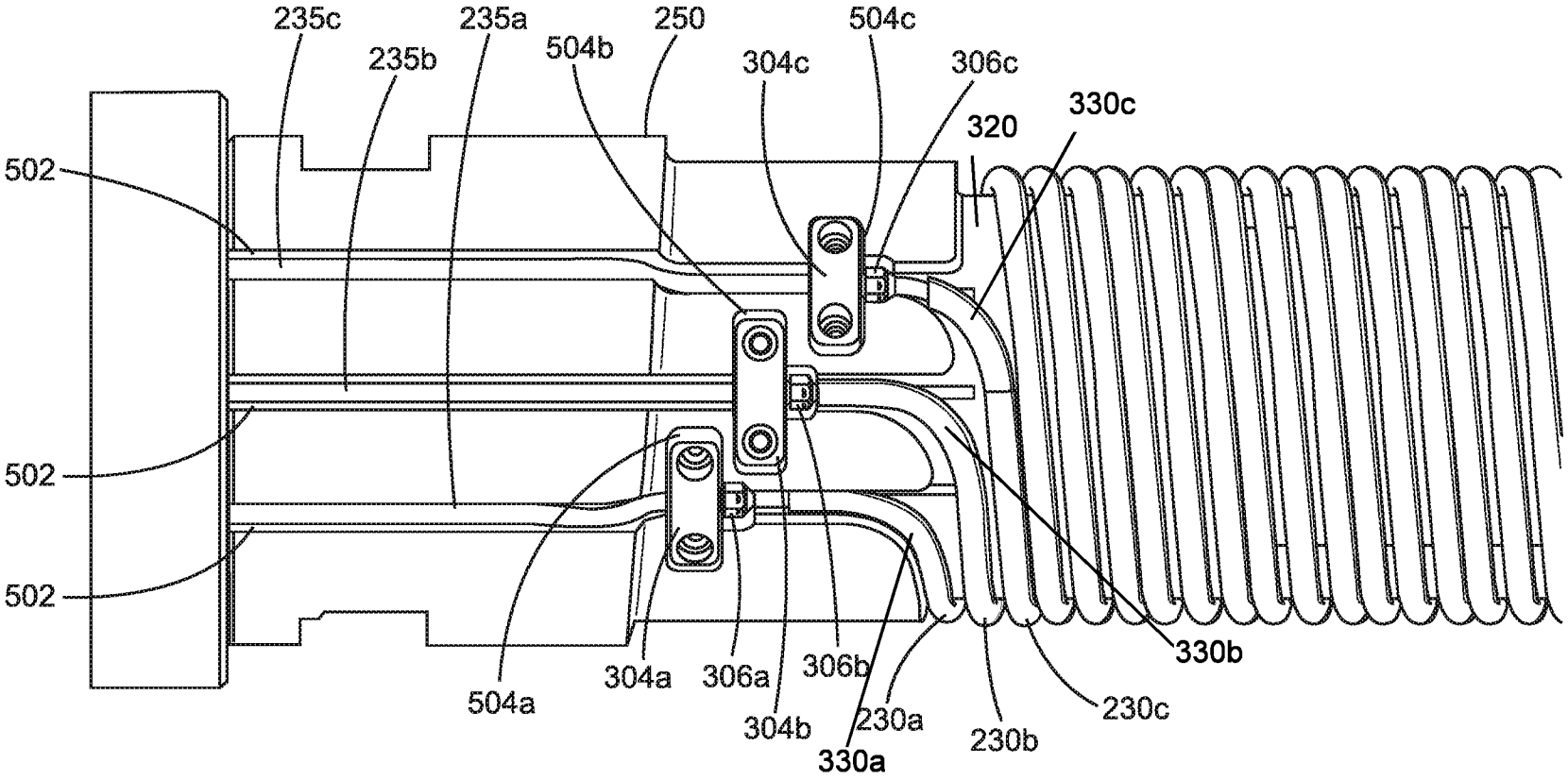
FIG. 3B shows a perspective view of the top sub of the travel joint assembly of FIG. 3A with the outer control line coil removed.

Turning now to FIG. 3A, a perspective view of an upper portion (also referred to as the "top sub") of the travel joint assembly 23 in accordance with an implementation of the present disclosure is depicted. The outer control line coil 240 may be coupled to the upper bushing 250 through an anchor block 304*d* and fixed thereto with a anchor block fitting 306. As shown in FIG. 3A, the upper bushing 250 may include additional anchor blocks 304*e*, 304*f*. Although the additional anchor blocks 304*e*, 304*f* are left unused in the illustrative embodiment of FIG. 3A, if desirable, they facilitate implementation of additional control lines in the outer control line coil 240. The anchor blocks 304*d*, 304*e*, 304*f* may be coupled to the upper bushing 250 with any suitable means. In certain implementations, the anchor blocks 304*d*, 304*e*, 304*f* may be coupled to the upper bushing 250 with one or more removable or permanent fasteners. For instance, in certain implementations, the anchor blocks 304*d*, 304*e*, 304*f* may be welded to the upper bushing 250. The outer straight length of control line 245 extends from the anchor block 304*d* along the outer surface of the upper bushing 250 to the upper sub 260.

FIG. 3B shows a perspective view of the top sub of the travel joint assembly 23 of FIG. 3A with the outer control line coil 240 removed. As shown in FIG. 3B, each of the control lines 230*a*, 230*b*, 230*c* of the inner control line coil 230 may be coupled to the upper bushing 250 using a corresponding anchor block 304*a*, 304*b*, 304*c*, respectively. Each of the control lines 230*a*, 230*b*, 230*c* may transition from the inner control line coil 230 to a corresponding straight length of control line 235*a*, 235*b*, 235*c* as shown in FIG. 3B. The anchor blocks 304*a*, 304*b*, 304*c* may be coupled to the upper bushing 250 with any suitable means. In certain implementations, the anchor blocks 304*a*, 304*b*, 304*c* may be coupled to the upper bushing 250 with fasteners or may be welded. The outer control line coil 240 is removed from FIG. 3B for illustrative purposes.

The control lines coils 230, 240 may be encapsulated with plastic or elastomeric material to prevent damage from rubbing or material loss from chaffing. Specifically, in certain implementations, the plastic encapsulation my be formed of high density polyethylene (HDPE), polyethylenechlorotriflouroethylene (ECTFE), Polyamide (Nylon), Flourinated ethylene proplylene (FEP), polyvinyl chloride (PVC), polyvinylidene fluoride (PVDF), Polyethylenetetraflouroethylene (ETFE), other polymeric compounds. In other embodiments, the encapsulation may be formed from elastomeric materials, including, but not limited to, neoprene, nitriles, Ethylene propylene diene monomer (EPDM), flouroelastomers (FKM) and/or perfluoroelastomers (FFKM), polytetrafluorethylene (PTFE), polyether ether ketone (PEEK), and/or other elastomeric materials. The encapsulation may be removed the points of transition between the control line coils 230, 240 and their corresponding inner straight length of control line 235 and outer straight length of control line 245 to permit the anchor blocks 304*a-f* to anchor onto the bare control line.

As shown in FIGS. 3A and 3B, each of the anchor blocks 304*a-f* may include a corresponding anchor block fitting 306*a-f* (collectively referred to as "anchor block fittings 306"). The anchor block fittings 306 anchor the control lines of each of the outer control line coil 240 and the inner control line coil 230 to a corresponding anchor block 304. The anchor block fittings 306 and the anchor blocks 304 prevent tension in the control lines of the inner control line coil 230 and the outer control line coil 240 from transferring to fittings 270. The fittings 270 in the upper sub 260 provide a pressure seal between tubing and annulus pressure. In order to avoid damaging the fittings 270 by tension and flexure of the straight lengths of control line 235, 245, these control lines are anchored to the upper bushing 250 by anchor block 304 and anchor block fittings 306, as discussed above.

In addition, the transition bend of the inner straight length of control line 235 and the outer straight length of control line 245 to the inner and the outer control line coils 230, 240 may need to be controlled to prevent fatigue failure. Specifically, the outer control line coil 240 and the inner control line coil 230 may each be supported radially by a corresponding outside surface 310, 320 of the upper bushing 250. For instance, in certain implementations as shown in FIGS. 3A and 3B, the upper bushing 250 may include grooves 502 that accommodate the end of control lines from the inner control line coil 230 and the outer control line coil 240 before a first transition bend 330*a-c* and 340 where each coil transitions into the inner straight length of control line 235 and the outer straight length of control line 245, respectively. This radial support from surface 310 and 320 prevents the coils 230, 240 and the transition bends 330*a*, 330*b*, 330*c*, 340 from bending in the radial direction. Controlling the bending of control lines of the coils 230, 240 is particularly important in deviated wells because the more deviated the wellbore is, the more the control lines 230*a-c*, 240*a* would want to bend in the radial direction.

FIGS. 3A and 3B illustrate how multiple control lines may be coiled around a single inner mandrel 210 and avoid nesting or rubbing while the inner mandrel 210 is moved. As can be seen in FIG. 3B, the control lines 230*a-c* of the inner control line coil 230 may be threaded through anchor block fittings 306 of corresponding anchor blocks 304*a-c*. In certain implementations, the upper bushing 250 may include recesses 504*a-f* to house the anchor blocks 304*a-f*. Similarly, the outer control line from the outer control line coil 240 may be threaded through a fitting 306*d* of another anchor block 304*d* installed in a recess 504*d* of the upper bushing 250.

As shown in FIGS. 3A and 3B, the upper bushing 250 may secure and separate a number of different control lines for axial movement. Although the upper bushing 250 separates four control lines (230*a-c*, 240*a*) in FIGS. 3A and 3B, any desired number of control lines may be separated in a similar manner without departing from the scope of the present disclosure. Specifically, the disclosed method and system of securing control lines is scalable to allow for additional control lines to be added. For instance, although not illustrated, in certain embodiments, an assembly could have a total of six control lines with each of the inner control line coil 230 and outer control line coil 240 having three control lines.

Moreover, as shown in FIGS. 3A and 3B, the anchor blocks 304*a-f* may be distributed radially along an outer perimeter of the upper bushing 250. Specifically, each of the anchor blocks 304*a-f* may be placed at a different radial location along the outer perimeter of the upper bushing 250. This distribution of the anchor blocks 304*a-f* permits each control line from the inner control line coil 230 and the outer control line coil 240 to transition into a corresponding straight length of control line at a different location along the outer perimeter of the upper bushing 250, making the control lines of the control line coils 230, 240 less susceptible to tension. Specifically, the radial distribution of anchor blocks 304*a-f* controls the winding of the control lines from the inner and outer control line coils 230, 240. This helps prevent nesting or control lines trying to slip over or on top of other control lines. The anchor blocks 304*a-f* and control line fittings 270 attach the control lines to the upper bushing 250 and transfers the tension from the control line coils 230, 240 to the upper bushing 250. As a result, the straight lengths of control line 235, 245 is isolated from the tension resulting from the weight of the control lines and the stiffness of the coils 230, 240 (acting like a spring) as the travel joint assembly 23 extends. The tension in the straight lengths of control line 235, 245 might cause the control lines 230*a-c*, 240*a* to slip from the control line fitting 270 and start leaking. If one of the control lines slips from control line fitting 270, the control line coils 230, 240 may become misaligned and start interfering with each other. The specific distribution configuration of the anchor blocks 304*a-f* shown in FIGS. 3A and 3B is shown for illustrative purposes only. The distribution of the anchor blocks 304*a-f* along the outer perimeter of the upper bushing 250 may be altered without departing from the scope of the present disclosure.

Figure 4:
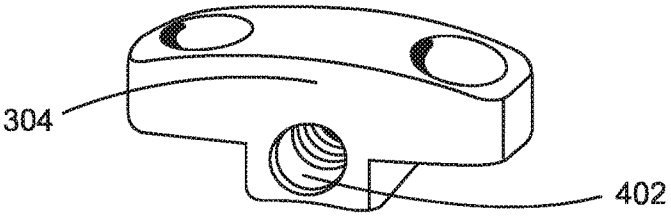
FIG. 4 depicts a close up view of an anchor block used in conjunction with a travel joint assembly in accordance with an illustrative embodiment of the present disclosure.

FIG. 4 depicts a close up view of an anchor block 304 that may be used in conjunction with the travel joint assembly 23 in accordance with an embodiment of the present disclosure. The anchor block fittings 306 may be installed to anchor the straight length of control lines 235, 245 into an opening 402 of the anchor block 304. In certain embodiments, the anchor block 304 may have multiple fittings (e.g., HIF fittings or wide HIF fittings) to hold multiple control lines in place. The anchor block fittings 306 may be made from any suitable material. For instance, in certain implementations, the anchor block fittings 306 may be made from nickel alloy steel (Inconel), stainless steel, alloy steel, or a combination thereof. As discussed above and depicted in FIGS. 3A and 3B, the anchor blocks 304 may be configured to sit in a corresponding recess (e.g., 504*a*, 504*b*, or 504*c*) of the upper bushing 250.

Figure 5A:
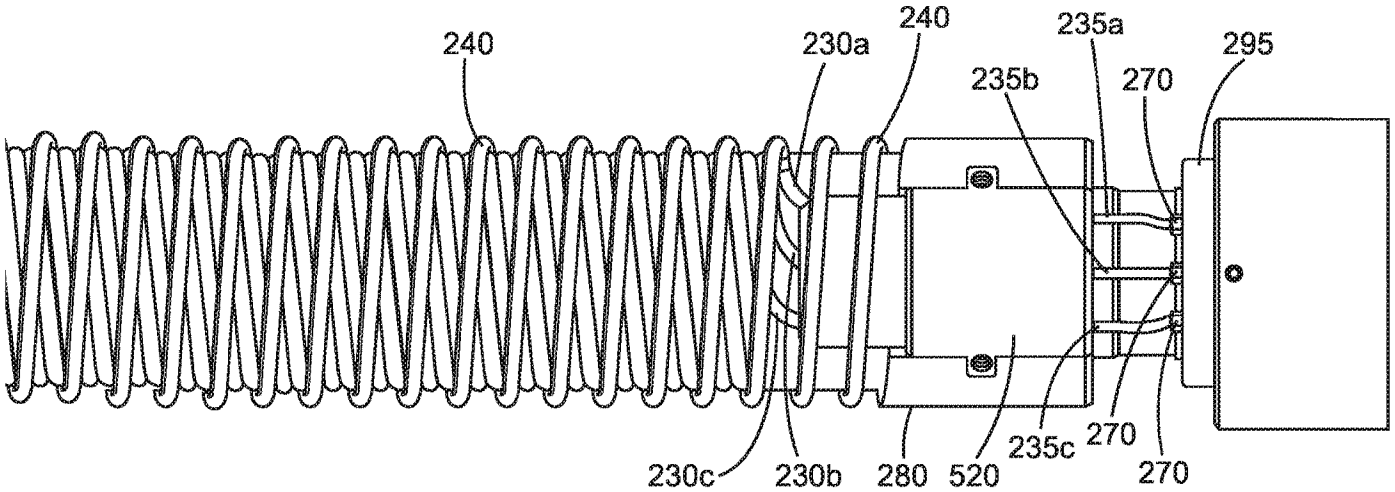
FIGS. 5A and 5B depict perspective views of a lower portion (also referred to as the "lower sub") of the travel joint assembly of FIG. 2B in accordance with an illustrative embodiment of the present disclosure.
Figure 5B:
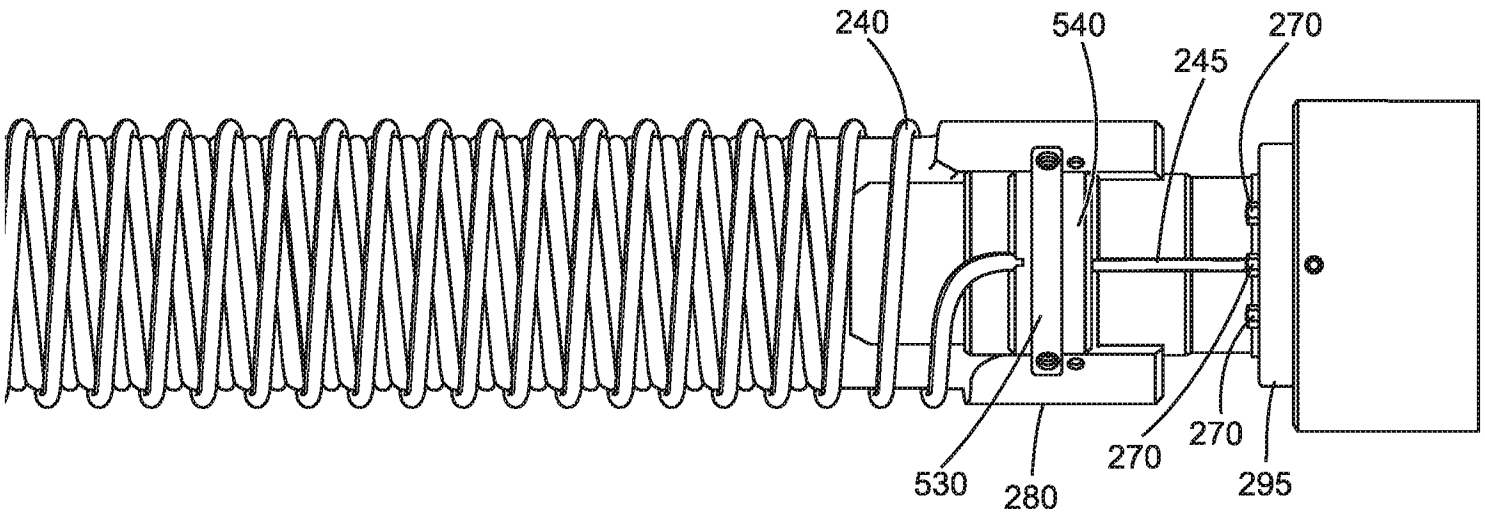

FIGS. 5A and 5B depict a perspective view of a lower portion of the travel joint assembly 23 in accordance with an illustrative embodiment of the present disclosure. The control lines 230*a-c* of the inner control line coil 230 are supported by the lower bushing 280. In certain implementations, the control lines 230*a-c* may transition from the inner control line coil 230 to corresponding straight length of control line 235*a*, 235*b*, 235*c* passing under a clamp 520. Each of the straight length of control line 235*a*, 235*b*, 235*c* may be anchored and sealed to the lower sub 295 by a corresponding control line fitting 270.

In the lower portion of the travel joint assembly 23 as with the upper portion, the outer control line coil 240 passes over the inner control line coil 230. As shown in FIG. 5B, the outer control line coil 240 may be supported by the lower bushing 280 and the outside surface of the clamp 520. The outer control line may transition from the outer control line coil 240 to the straight length of control line 245 and may be secured by any suitable means known to those of ordinary skill in the art. For instance, in certain embodiments, the straight length of control line 245 may be secured by a first clamp 530 and a second clamp 540. The straight length of control line 245 may be sealingly secured to the lower sub 295 by a control line fitting 270. The clamp 540 may align the straight length of control line 245 with the control line fitting 270. The clamp 530 may hold the clamp 540 in place and be secured to the lower bushing 280 by one or more fasteners.

Like the upper bushing 250, the lower bushing 280 may separate the four control lines 230*a-c*, 240*a* and prevent them from nesting or rubbing while moving. FIG. 5A illustrates three control line fittings 270 where the inner control lines 230*a-c* pass into the lower sub 295. Similarly, the control line from the outer control line coil 240 may pass into the lower sub 295 through a control line fitting 270. In certain implementations, the control line fittings 270 may be HIF fittings. The control line fittings 270 are capable of isolating the tubing pressure from the annulus pressure when the travel joint assembly 23 is extended.

Accordingly, each of the inner control line coil 230 and the outer control line coil 240 is wrapped around an outer surface of the inner mandrel and includes a first portion located uphole relative to the upper bushing and a second portion located downhole relative to the lower bushing. The first portion and the second portion of the inner control line coil 230 and the outer control line coil 240 are separated by an inner straight length of control line 235 and an outer straight length of control line 245. The distal ends of the inner straight length of control line 235 and the outer straight length of control line 245 are coupled to the upper bushing 250 and the lower bushing 280 using a fastener. For instance, in certain implementations, anchor blocks 304 and control line fittings 270 may be used to couple the inner straight length of control line 235 and the outer straight length of control line 245 to the upper bushing 250. Similarly, control line fittings 270 and one or more clamps 520, 530, 540 may be used to couple the inner straight length of control line 235 and the outer straight length of control line 245 to the lower bushing 280. This configuration minimizes tension in the inner control line coil 230 and the outer control line coil 240 as the travel joint assembly 23 moves between its extended and compressed position. Accordingly, the method and system disclosed herein may be used to effectively transmit any desired signals from a first axial location along a wellbore to a second axial location thereof across a travel joint that is movable between an expanded and a contracted position. Specifically, the anchor blocks 304*a-f* and the clamps 520, 530, 540 couple the control lines from the inner control line coil 230 and the outer control line coil 240 to the upper bushing 250 and the lower bushing 280. This configuration isolates the tension from the expanding and contracting control lines as well as the weight of the control lines. Accordingly, the control line fittings 270 that provide a pressure seal at the upper sub 260 and the lower sub 295 remain static and are therefore isolated from tension.

Although the present invention is discussed in conjunction with a configuration having two control line coils 230, 240, a different number of control line coils may be used without departing from the scope of the present disclosure. Specifically, in other embodiments, three or more control line coils may be used in a similar manner. Alternatively, in certain implementations, a single control line coil may be used without departing from the scope of the present disclosure. For instance, either one of the inner control line coil 230 or the outer control line coil 240 may be eliminated.

Further, the present disclosure is not limited to any specific wellbore orientation. Specifically, the methods and systems disclosed herein are equally applicable to wellbores having any orientation including, but not limited to, vertical wellbores, slanted wellbores, or multilateral wellbores. Accordingly, the directional terms such as "above", "below", "upper", "lower", "upward", "downward", "uphole", and "downhole" are used for illustrative purposes only to describe the illustrative embodiments as they are depicted in the figures. Moreover, although an offshore operation is depicted in the illustrative embodiment of FIG. 1, the methods and systems disclosed herein are equally applicable to onshore operations. Further, the methods and systems disclosed herein are equally applicable to a cased hole completion and an open hole completion without departing from the scope of the present disclosure.

The present invention is therefore well-adapted to carry out the objects and attain the ends mentioned, as well as those that are inherent therein. While the invention has been depicted, described and is defined by references to examples of the invention, such a reference does not imply a limitation on the invention, and no such limitation is to be inferred. The invention is capable of considerable modification, alteration and equivalents in form and function, as will occur to those ordinarily skilled in the art having the benefit of this disclosure. The depicted and described examples are not exhaustive of the invention. Consequently, the invention is intended to be limited only by the spirit and scope of the appended claims, giving full cognizance to equivalents in all respects.

What is claimed is:

1. A travel joint assembly comprising:

an inner mandrel;

an upper bushing and a lower bushing extending along an outer surface of the inner mandrel;

an inner straight length of control line and an outer straight length of control line, each having a first portion extending uphole relative to the upper bushing and a second portion extending downhole relative to the lower bushing each wrapped around the inner mandrel and extending between the upper bushing and the lower bushing;

an inner control line coil extending between the first portion and the second portion of the inner straight length of control line;

an outer control line coil extending between the first portion and the second portion of the outer straight length of control line;

wherein the first portion of the inner straight length of control line and the first portion of the outer straight length of control line are each disposed through a respective pressure sealed control line fitting;

wherein the second portion of the inner straight length of control line and the second portion of the outer straight length of control line are each disposed through a respective pressure sealed control line fitting;

at least one fastener disposed on the upper bushing to connect the inner control line coil to the first portion of the inner straight length of control line and to connect the outer control line coil to the first portion of the outer straight length of control line, wherein the at least one fastener on the upper bushing longitudinally aligns the first portion of the inner straight length of control line and the first portion of the outer straight length of control line with their respective control line fittings; and at least one fastener disposed on the lower bushing to connect the inner control line coil to the second portion of the inner straight length of control line and to connect the outer control line coil to the second portion of the outer straight length of control line, wherein the at least one fastener on the lower bushing longitudinally aligns the second portion of the inner straight length of control line and the second portion of the outer straight length of control line with their respective control line fittings.

2. The travel joint assembly of claim 1, wherein at least one of the inner control line coil and the outer control line coil comprises a plurality of control lines.

3. The travel joint assembly of claim 1, further comprising an upper sub coupled to an uphole end of the upper bushing and a lower sub coupled to a downhole end of the lower bushing, wherein at least one of the control line fittings is coupled to at least one of the upper sub and the lower sub.

4. The travel joint assembly of claim 3, wherein at least one of the control line fittings is coupled to an uphole end of the upper sub, and wherein at least one of the control line fittings is coupled to an uphole end of the lower sub at an interface between the lower bushing and the lower sub.

5. The travel joint assembly of claim 1, wherein the at least one fastener disposed on the upper bushing comprises a first anchor block and a second anchor block each coupled to the upper bushing.

6. The travel joint assembly of claim 5, wherein the first anchor block is positioned at a first radial position along an outer perimeter of the upper bushing and the second anchor block is positioned at a second radial position along the outer perimeter of the upper bushing.

7. The travel joint assembly of claim 5, wherein the upper bushing comprises a recess, wherein at least one of the first anchor block and the second anchor block comprises an extension having an opening formed therethrough, wherein the extension is inserted in the recess.

8. The travel joint assembly of claim 7, wherein at least one of the first anchor block and the second anchor block comprises an anchor block fitting installed therein that anchors the first portion of the inner straight length of control line or the outer straight length of control line into the opening of the first anchor block or the second anchor block.

9. The travel joint assembly of claim 1, wherein the at least one fastener disposed on the lower bushing comprises a clamp that couples at least one of the inner straight length of control line and the outer straight length of control line to the lower bushing.

10. The travel joint assembly of claim 1, wherein at least one of the control line fittings is coupled to at least one of the upper bushing and the lower bushing.

11. The travel joint assembly of claim 1, wherein the inner control line coil is wrapped around the inner mandrel and wherein the outer control line coil is wrapped around the inner control line coil.

12. The travel joint assembly of claim 11, wherein the inner control line coil and the outer control line coil are wrapped in opposite directions.

13. A system for arranging one or more control lines along a travel joint assembly in a manner that permits axial movement of the travel joint assembly comprising:

an upper bushing located at a first distal end of the travel joint assembly;

a lower bushing located at a second distal end of the travel joint assembly;

a first straight length of control line having a first portion extending uphole relative to the first distal end of the travel joint assembly and a second portion extending downhole relative to the second distal end of the travel joint assembly;

a second straight length of control line having a first portion extending uphole relative to the first distal end of the travel joint assembly and a second portion extending downhole relative to the second distal end of the travel joint assembly;

an anchor block disposed on the upper bushing and coupling the first portion of at least one of the first straight length of control line and the second length of control line to the upper bushing;

at least one clamp disposed on the lower bushing and coupling the second portion of at least one of the first straight length of control line and the second straight length of control line to the lower bushing;

a first control line coil corresponding to the first straight length of control line extending between the first portion and the second portion of the first straight length of control line; and a second control line coil corresponding to the second straight length of control line extending between the first portion and the second portion of the second straight length of control line, wherein the first control line coil is wrapped around an inner mandrel of the travel joint assembly, and wherein the second control line coil is wrapped around the first control line coil.

14. The system of claim 13, wherein the anchor block comprises an anchor block fitting installed therein that anchors the first portion of at least one of the first straight length of control line and the second length of control line into an opening of the anchor block.

15. The system of claim 13, further comprising an upper sub coupled to the upper bushing and a lower sub coupled to the lower bushing, wherein at least one of the first straight length of control line and the second straight length of control line is directed through at least one of the upper sub and the lower sub.

16. The system of claim 15, wherein the upper sub comprises pressure sealed control line fittings, wherein the first portion of the first straight length of control line and the first portion of the second straight length of control line are connected to the upper sub via the pressure sealed control line fittings on the upper sub, wherein the lower sub comprises pressure sealed control line fittings, and wherein the second portion of the first straight length of control line and the second portion of the second straight length of control line are connected to the lower sub via the pressure sealed control line fittings on the lower sub.

17. A method of arranging a control line coil along a travel joint comprising:

coupling an inner mandrel to an upper bushing and a lower bushing;

wrapping the control line coil along an outer surface of the inner mandrel;

coupling a first distal end of the control line coil to the upper bushing via a fastener and coupling a second distal end of the control line coil to the lower bushing via a fastener;

extending a first straight length of control line from the fastener on the upper bushing into a pressure sealed control line fitting disposed on an upper sub coupled to the upper bushing, wherein the fastener on the upper bushing longitudinally aligns the first straight length of control line with the pressure sealed control line fitting on the upper sub; and extending a second straight length of control line from the fastener on the lower bushing into a pressure sealed control line fitting disposed on a lower sub coupled to the lower bushing, wherein the fastener on the lower bushing longitudinally aligns the second straight length of control line with the pressure sealed control line fitting on the lower sub.

18. The method of claim 17, wherein coupling the first distal end of the control line coil to the upper bushing comprises coupling an anchor block to the upper bushing and disposing the first distal end of the control line coil within the anchor block.

19. The method of claim 18, wherein coupling the anchor block to the upper bushing comprises inserting an extended portion of the anchor block into a recess formed on an outer surface of the upper bushing, and wherein disposing the first distal end of the control line coil within the anchor block comprises installing the first distal end of the control line coil into an opening formed in the extended portion of the anchor block via an anchor block fitting.

20. The method of claim 17, wherein coupling the second distal end of the control line coil to the lower bushing comprises using at least one clamp to couple the second distal end of the control line coil to the lower bushing.

* * * * *